US008099941B2

(12) United States Patent
Myers et al.

(10) Patent No.: US 8,099,941 B2
(45) Date of Patent: Jan. 24, 2012

(54) METHODS AND SYSTEMS FOR CONTROLLING A COMBUSTOR IN TURBINE ENGINES

(75) Inventors: Geoffrey David Myers, Simpsonville, SC (US); Lewis Berkley Davis, Jr., Niskayuna, NY (US); Timothy Andrew Healy, Simpsonville, SC (US); Jospeh Citeno, Greenville, SC (US)

(73) Assignee: General Electric Company, Schenectady, NY (US)

( * ) Notice: Subject to any disclaimer, the term of this patent is extended or adjusted under 35 U.S.C. 154(b) by 488 days.

(21) Appl. No.: 12/347,147

(22) Filed: Dec. 31, 2008

(65) Prior Publication Data

US 2010/0162724 A1 Jul. 1, 2010

(51) Int. Cl.
*F02C 7/057* (2006.01)

(52) U.S. Cl. ..... 60/39.23; 60/39.27; 60/785

(58) Field of Classification Search ..... 60/39.23, 60/39.27, 737, 738, 776, 785
See application file for complete search history.

(56) References Cited

U.S. PATENT DOCUMENTS 3,869,246 A * 3/1975 Hammond et al. ..... 431/351
3,958,413 A * 5/1976 Cornelius et al. ..... 60/778
4,050,240 A * 9/1977 Vaught ..... 60/39.23
4,138,842 A * 2/1979 Zwick ..... 60/39.23
4,255,927 A * 3/1981 Johnson et al. ..... 60/39.23
4,459,803 A * 7/1984 Marshall ..... 60/39.23
5,327,718 A * 7/1994 Iwata et al. ..... 60/773
5,533,329 A * 7/1996 Ohyama et al. ..... 60/773
5,819,540 A * 10/1998 Massarani ..... 60/732
6,263,663 B1 * 7/2001 Grienche et al. ..... 60/794
6,425,240 B1 * 7/2002 Park ..... 60/39.23
6,722,135 B2 4/2004 Davis, Jr.
6,810,655 B2 11/2004 Davis, Jr.
6,892,543 B2 * 5/2005 Nakae ..... 60/773
7,493,770 B2 2/2009 Christianson
2004/0107701 A1 * 6/2004 Miyake et al. ..... 60/772

* cited by examiner

*Primary Examiner* — Louis Casaregola
*Assistant Examiner* — Phutthiwat Wongwian
(74) *Attorney, Agent, or Firm* — Sutherland Asbill & Brennan LLP

(57) ABSTRACT

Methods and systems for controlling a combustor for a gas turbine engine are provided. According to one example embodiment, a system includes an air control assembly associated with at least one air path of a combustor for a gas turbine engine. Additionally, the system also includes at least one sensor for sensing at least one operating parameter of the gas turbine engine. Further, the system also includes a controller operable to receive at least one operating parameter sensed by the at least one sensor, and further operable to selectively control an air control assembly based at least in part on the at least one operating parameter sensed by the at least one sensor.

18 Claims, 10 Drawing Sheets

METHODS AND SYSTEMS FOR CONTROLLING A COMBUSTOR IN TURBINE ENGINES

FIELD OF THE INVENTION

The invention relates generally to turbine engines, and more specifically relates to methods and systems for controlling a combustor in turbine engines.

BACKGROUND OF THE INVENTION

Conventional turbine engines include three main parts, a compressor, a combustor, and a turbine. Fuel is mixed with compressed air from the compressor and burned in the combustor. The resulting flow of combustion products out of the combustor subsequently drives the turbine. Typically, the fuel and air may be mixed in a fuel pre-mixer, before being injected into the combustor. Alternatively, the fuel and air may be directly injected into the combustor without premixing. This may result in a high temperature combustion, leading to the production of considerable volumes of NO and $NO_2$, generally referred to as NOx. Premixing the fuel and air prior to combustion to maintain a lean fuel-air ratio produces lower reaction zone temperatures and thus lowers NOx emissions.

However, if the fuel-air mixture is too lean, it may result in incomplete combustion leading to excessive emissions of carbon monoxide (CO) and unburned hydrocarbon (UHC). Additionally, low fuel-air ratio may also result in flame blowout requiring the engine to be started all over again. To minimize CO and UHC emissions, the reaction zones in the combustor of turbines engines may have a fuel-air ratio sufficient enough to avoid blowout but lean enough to significantly reduce NOx emissions. To balance the conflicting needs for reduced CO, UHC, and NOx emissions, extremely precise control is required over the fuel-air mixture in the reaction zones of the combustor in an industrial turbine engine.

Operation at low bulk fuel/air ratio, near a lean extinction limit, is particularly difficult at reduced load. That is, during off-peak hours operating a generator at full output is not practical. Any energy produced over demand that is not otherwise sold is wasted. Accordingly, balancing low output with lean operation while mainlining emissions compliance is difficult. In order to address this problem the turbine engine is operated at a piloted-premix in which some 10 to 20% of the fuel is injected directly into the reaction zone and burns as a high temperature diffusion flame. This provides good stability and combustion efficiency, but NOx levels are out-of-compliance. Thus, the turbine engine is alternately operated in an out of compliance state and in compliances state to maintain average emissions output in compliance.

In addition to the above, restarting a turbine combined cycle generator that was shut off is a lengthy process that may take an hour or more before full output is achieved. This lost time can be quite costly for an energy producer. Moreover, a generator that is shut off is not available in the event that additional output is unexpectedly needed during a low demand period. In addition, starting and stopping a generator impacts the durability and life of power system components. Frequent starts and stops will have a detrimental impact on engine reliability and trigger a need for more frequent maintenance cycles thus increasing operational and maintenance costs.

Given the drawbacks associated with stopping the gas or combined cycle turbine engine, energy producers prefer to turn down or park the engine during off peak hours to minimize the fuel burned while maintaining the ability to respond to an unplanned increase in load. Parking the turbine engine at a point that allows a quick return to full power, while also remaining emission compliant, can be difficult for the reasons outlined above. Therefore, when parking a turbine engine, the engine is operated at a specific part load condition with brief periods of out-of-compliance operation. While effective at maintaining a turbine engine within emission compliance, achievable part load conditions are still high, in the range of 40% of normal output, and thus can represent substantial operational inefficiencies.

In addition to the above, an important over-arching constraint that represents a significant initial barrier and steady, day-to-day struggle in successfully addressing all emissions, reliability and operational flexibility requirements of a turbine engine is the variation inherent in any 'real-world' power plant context. Performance of a lean, premixed combustion system may be impacted by minute changes in external variables. Variation in individual fuel circuit flow (fractions of 1% of the total), night/day and seasonal variations in ambient temperature and relative humidity, site location and elevation, and incremental (a few percent by volume) changes in fuel gas composition, as well as power system load, can impact combustion system performance.

Moreover, in turbine engines having a plurality of combustors, such as in a can-annular architecture, it is important that the fuel-air ratio in each combustor of the can-annular design should be substantially the same or adjusted as appropriate for the system design. For example, a constant fuel-air mixture in each combustor allows the mixture to be maintained at the lean ratio that best reduces CO, UHC, and NOx emissions. In addition, uniform fuel-air ratios among the different combustors ensure a uniform distribution of temperature among the combustors of a turbine engine. A uniform distribution of temperature and pressure reduces the thermal and mechanical stresses on the combustion, turbine, and other hot stream components of the turbine engine. A reduction in these stresses prolongs the operational lives of the different combustors and turbine parts. Peak hot gas temperature in some amongst the combustors increases thermal stresses and reduces the strength of materials in the hotter high fuel-air ratio chambers and turbine parts immediately downstream of those chambers.

However, achieving truly uniform temperature and pressure distribution in the different combustors in a can-annular architecture has traditionally been found to be difficult. This may be due to the inherent variations existing between the similar combustors forming the can-annular architecture. These variations arise out of the tolerances involved in the manufacturing, installation, and assembly of each of the combustors with other components the turbine engine. These variations in the components of the combustors and their assembly can perturb the incoming air flow into the combustors. The different perturbations can cause different non-uniformities to the flow in the different combustors. Thus, the fuel-air ratio is affected differently in each combustor. Variations in the air flow in each combustor can make it difficult to maintain constant fuel-air ratios in all the combustors. Thus, to maintain uniform fuel-air ratios in the different combustors, the airflow in the different combustors need to be controlled. The current literature manages airflow balance by precise control of circuit effective flow areas, such as requiring close manufacturing and assembly tolerances. In practice, the level of manufacturing precision and the functional testing required can be costly. Further, there are high thermal and mechanical operating loads on the turbine engine that result in deformation, creep and loss of dimensional control.

Accordingly, there is a need for methods and systems for controlling a combustor in turbine engines. There is a further need for controlling the air flow in a combustor in turbine engines. There is yet a further need for dynamic balancing of the air flow to a combustor that can account for the structural and dimensional changes in the components of the turbine engine over time.

BRIEF DESCRIPTION OF THE INVENTION

Embodiments of the invention can address some or all of the needs described above. According to one embodiment of the invention, there is disclosed a system for controlling a combustor for a turbine engine. The system may include an air control assembly operably associated with at least one air path of a combustor for a turbine engine. Additionally, the system may include at least one sensor operable to sense at least one operating parameter of the turbine engine. Further, the system may include a controller operable to selectively control the air control assembly based at least in part on the at least one operating parameter sensed by the at least one sensor.

According to another embodiment of the invention, there is disclosed a method for controlling a turbine engine. The method may include receiving at least one operating parameter from at least one sensor associated with a turbine engine. Further, the method may involve selectively controlling, based at least in part on the at least one operating parameter received from the at least one sensor, an air control assembly associated with an air path of a combustor of the turbine engine.

According to yet another embodiment of the invention, there is disclosed a method for controlling a turbine engine comprising a plurality of combustors. The method involves receiving a first operating parameter from a first sensor associated with a first combustor of the turbine engine, and also receiving a second operating parameter from a second sensor associated with a second combustor of the turbine engine. The method further involves selectively controlling, based at least in part on the first operating parameter, a first air control assembly associated with the first combustor, and selectively controlling, based at least in part on the second operating parameter, a second air control assembly associated with the second combustor.

Other embodiments, aspects, and features of the invention will become apparent to those skilled in the art from the following detailed description, the accompanying drawings, and the appended claims.

BRIEF DESCRIPTION OF THE DRAWINGS

Figure 1:
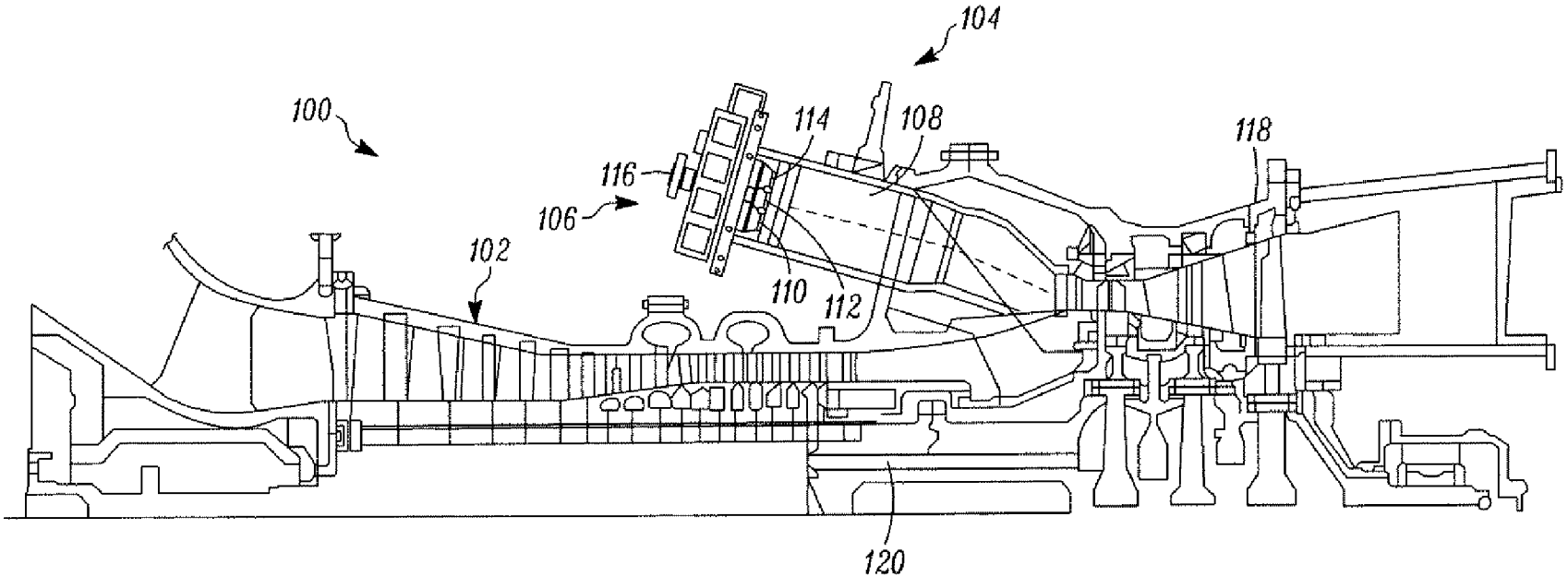

Having thus described the invention in general terms, reference will now be made to the accompanying drawings, which are not necessarily drawn to scale, and wherein:

FIG. 1 illustrates a partial representation of an example turbine engine, in accordance with an embodiment of the invention.

Figure 2:
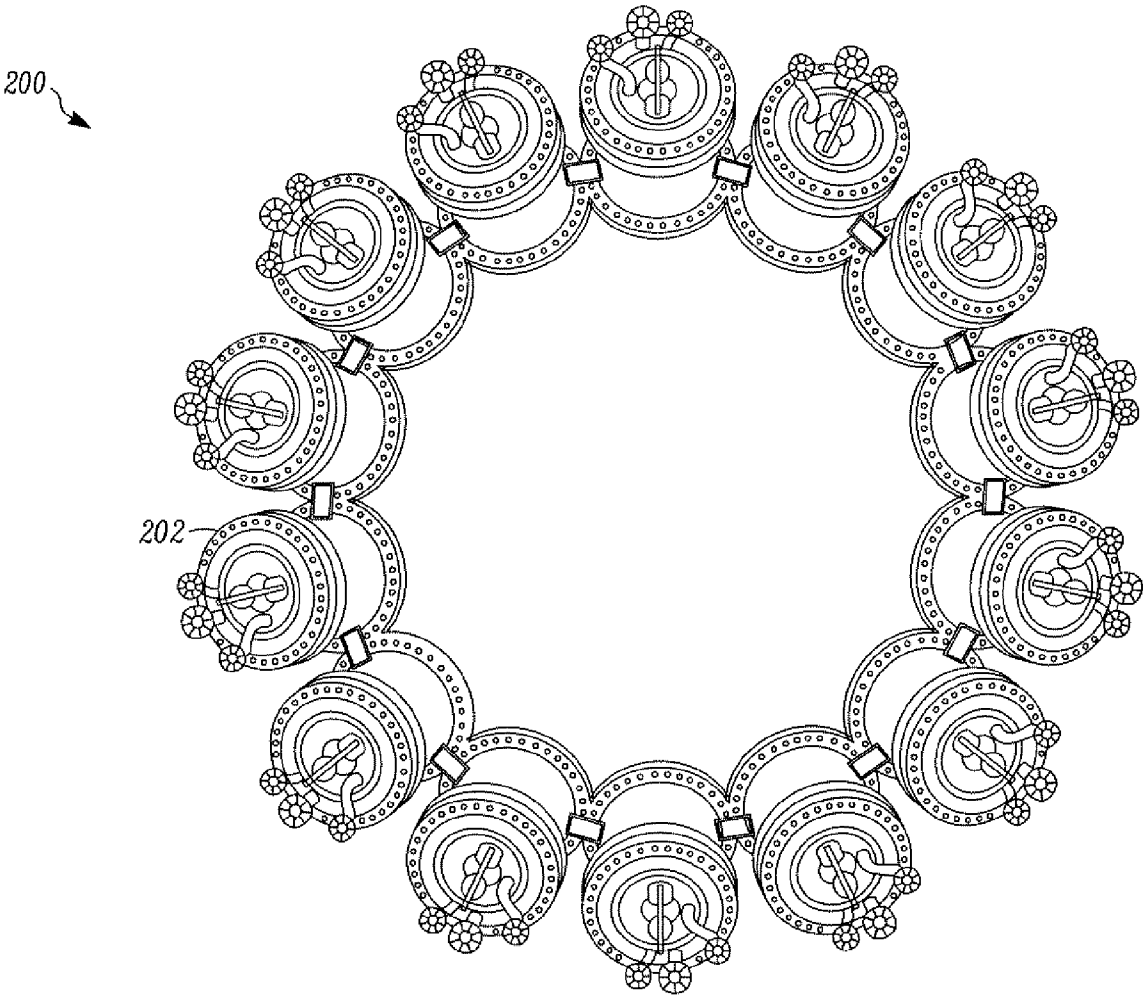

FIG. 2 illustrates an example combustor, in accordance with an embodiment of the invention.

Figure 3:
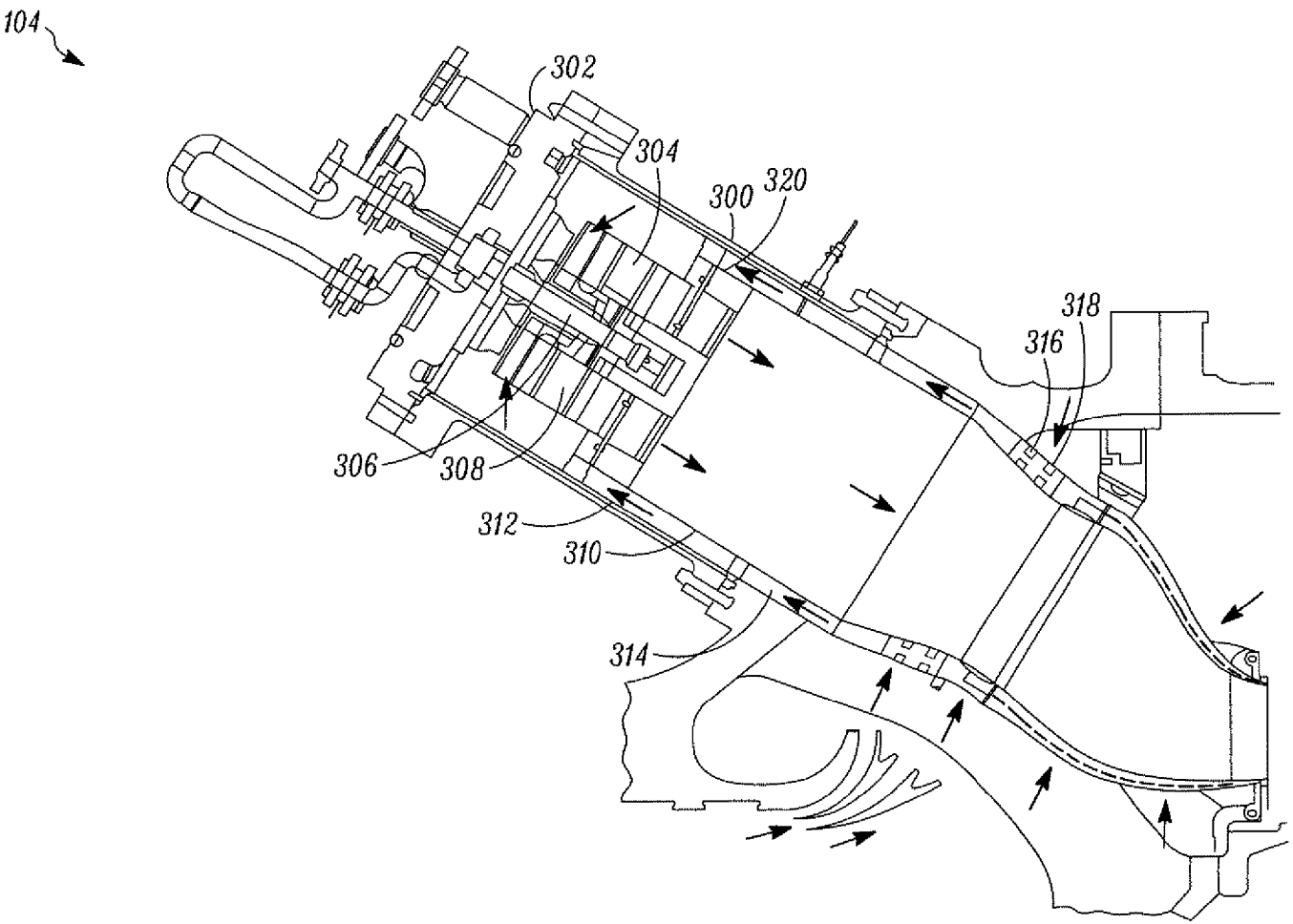

FIG. 3 illustrates an example combustor assembly, in accordance with an embodiment of the invention.

Figure 4:
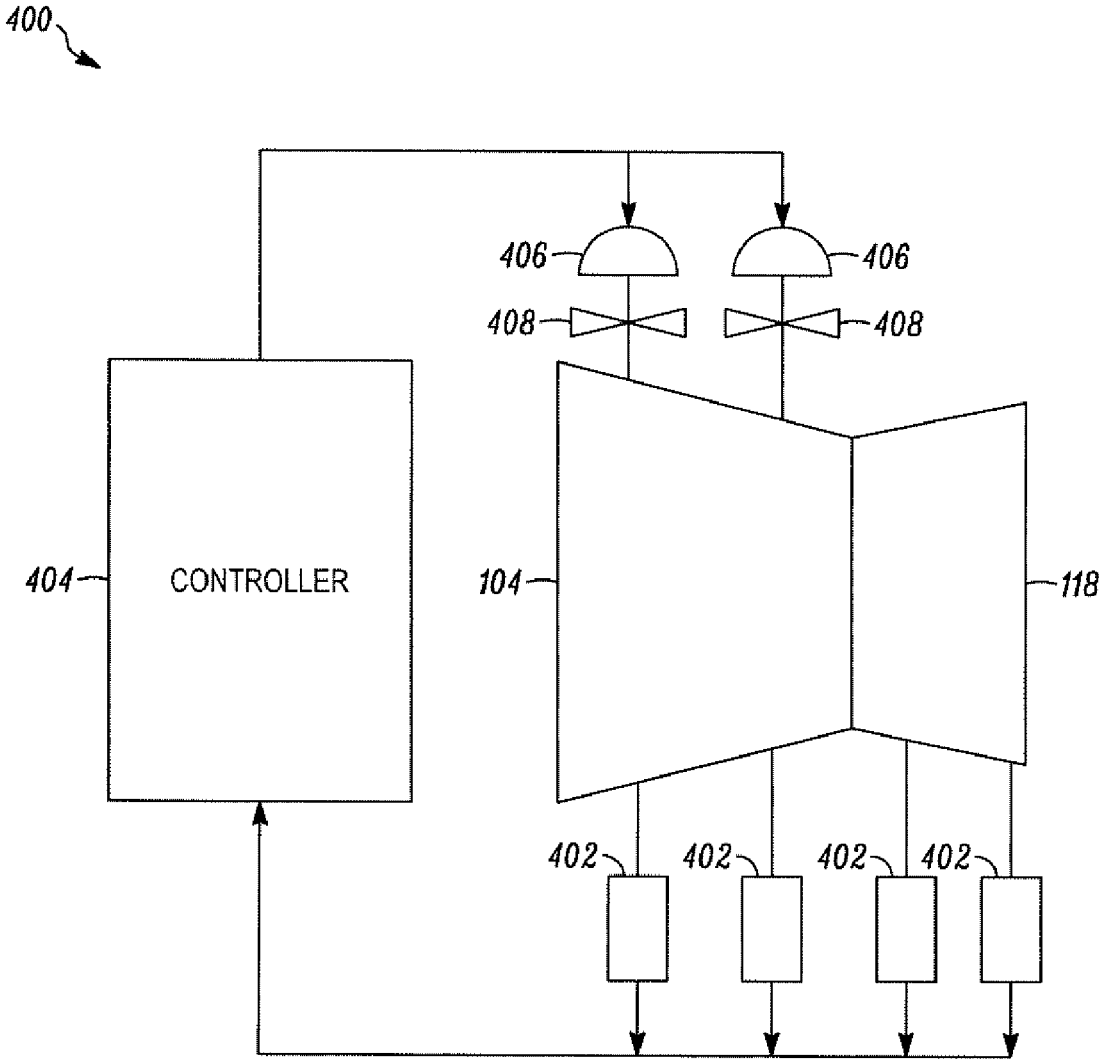

FIG. 4 illustrates an example control system in a turbine engine, in accordance with an embodiment of the invention.

Figure 5:
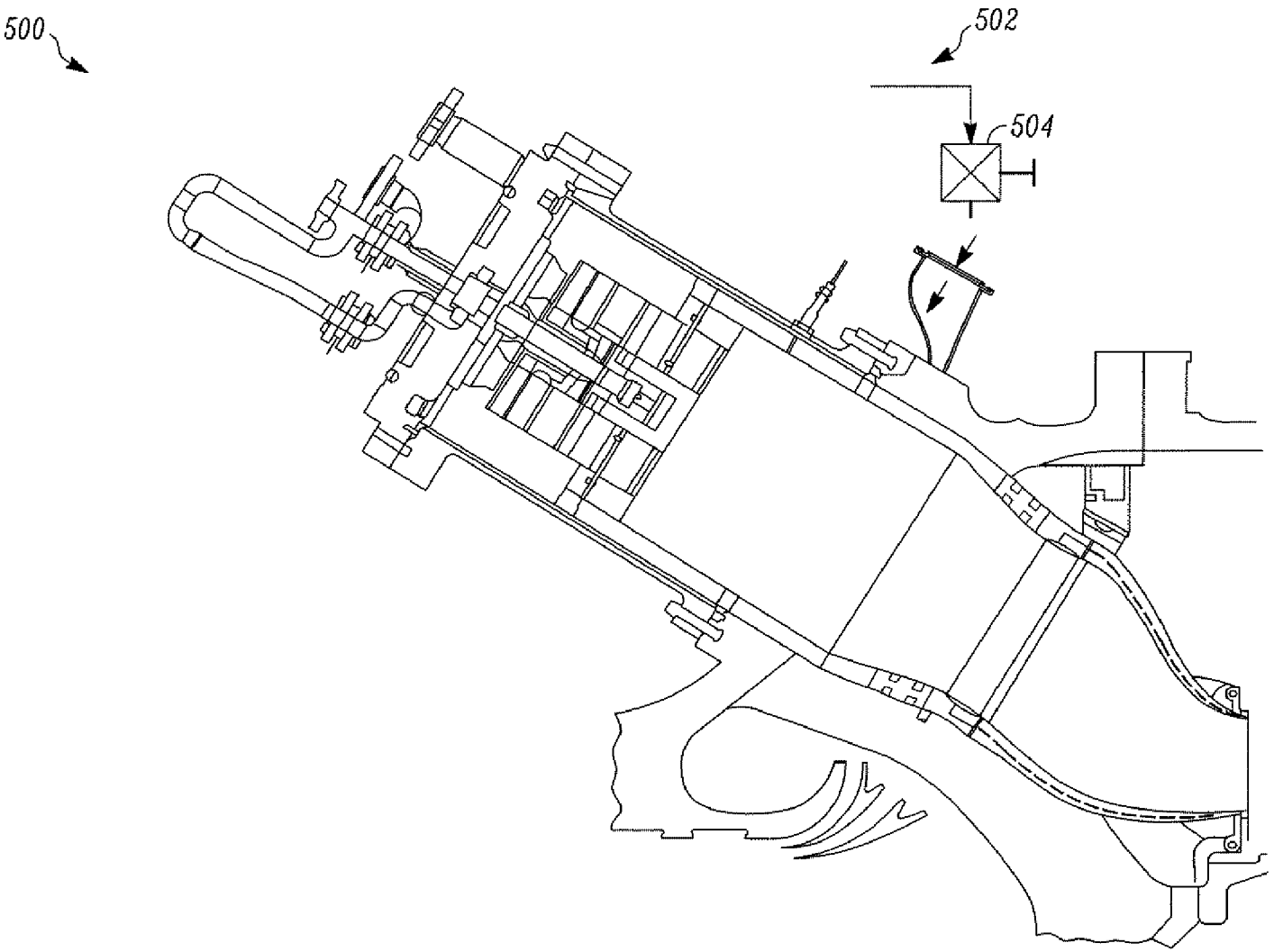

FIG. 5 illustrates an example combustor assembly, in accordance with an embodiment of the invention.

Figure 6:
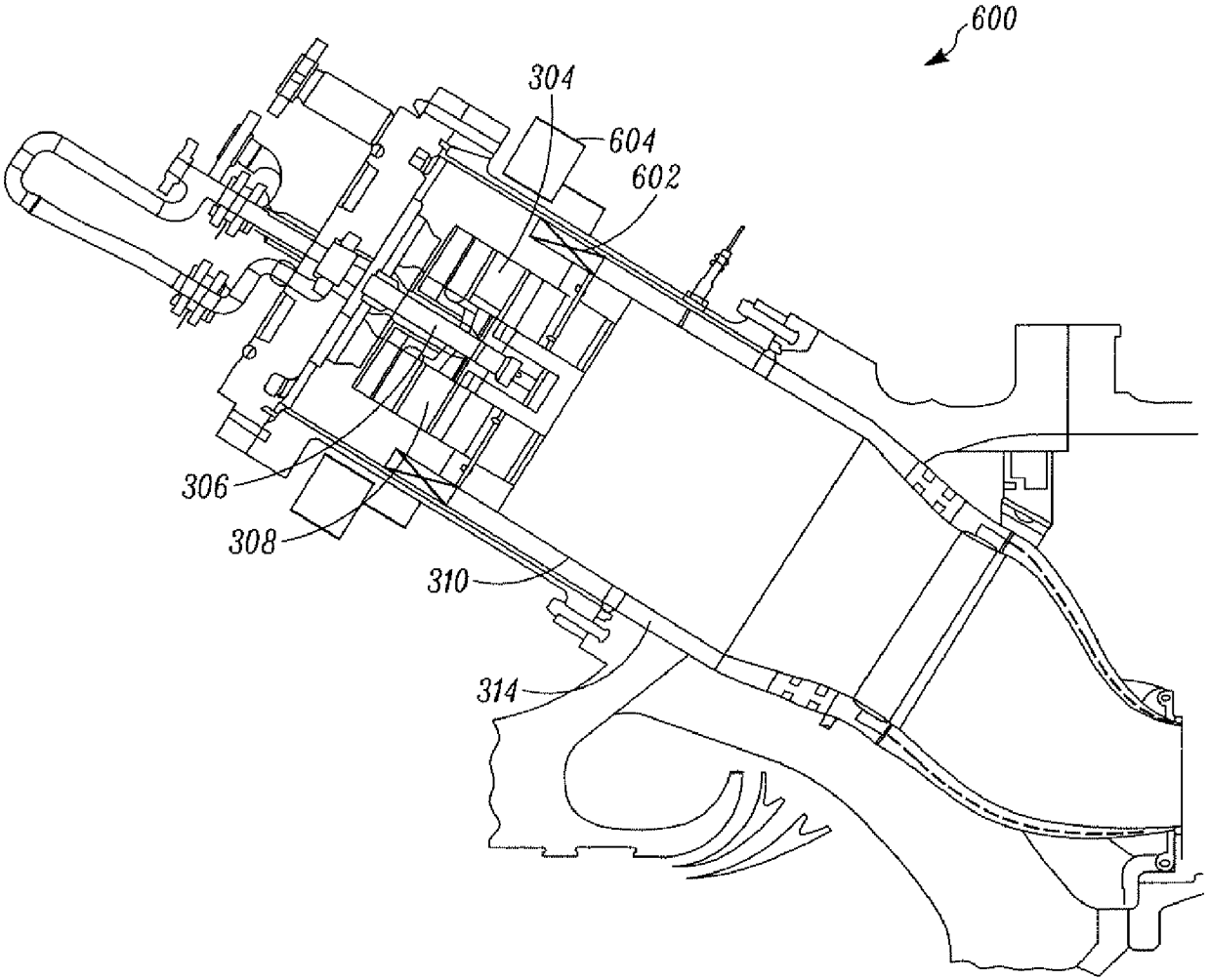

FIG. 6 illustrates an example combustor assembly, in accordance with an embodiment of the invention.

Figure 7:
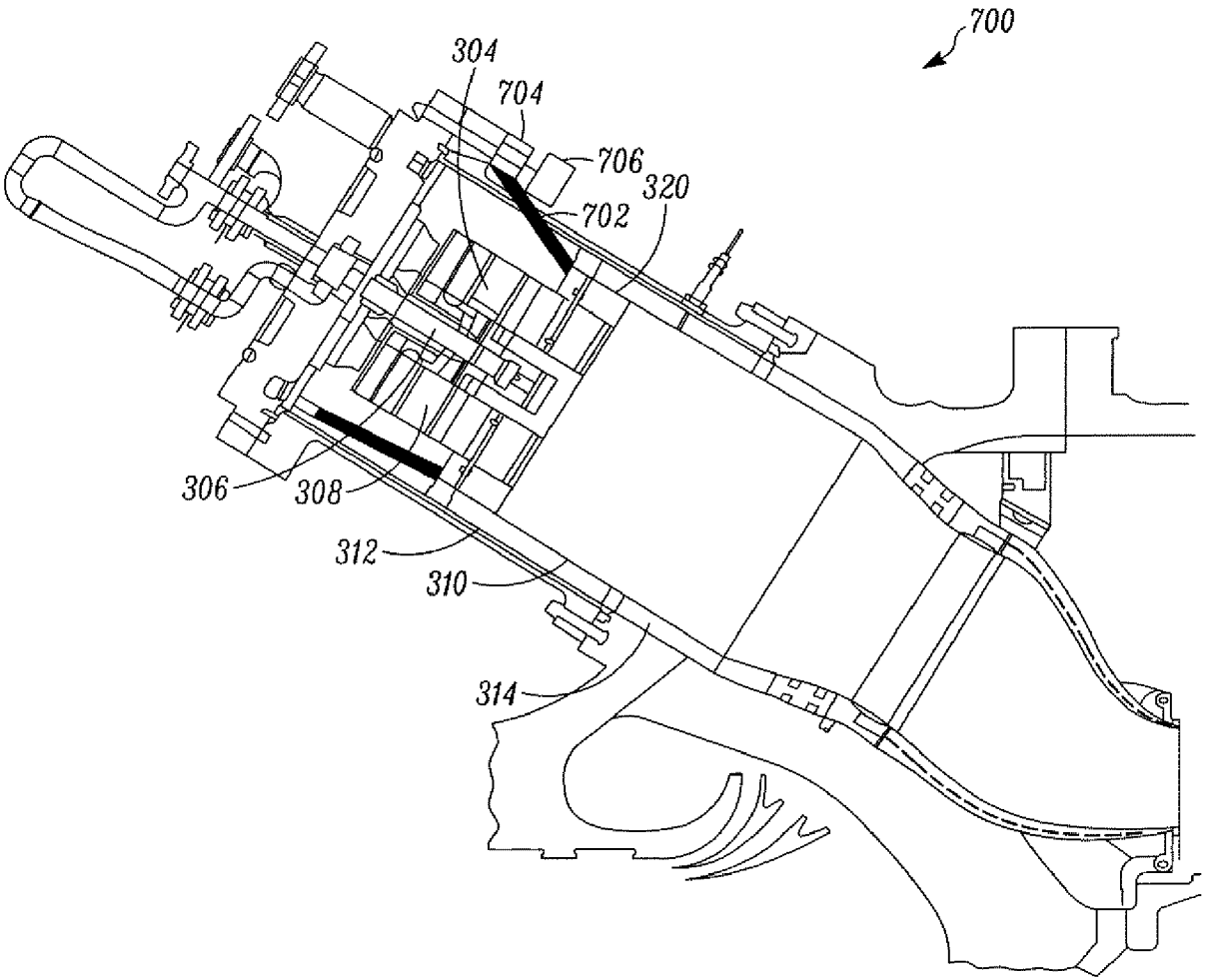

FIG. 7 illustrates an example combustor assembly, in accordance with an embodiment of the invention.

Figure 8:
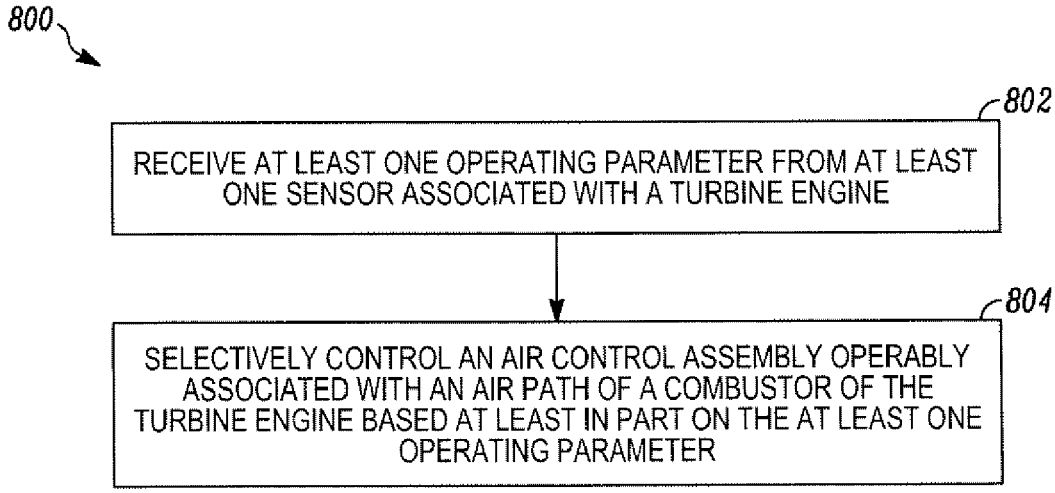

FIG. 8 illustrates a flowchart of an example method for altering the airflow associated with a combustor in a turbine engine, in accordance with an embodiment of the invention.

Figure 9:
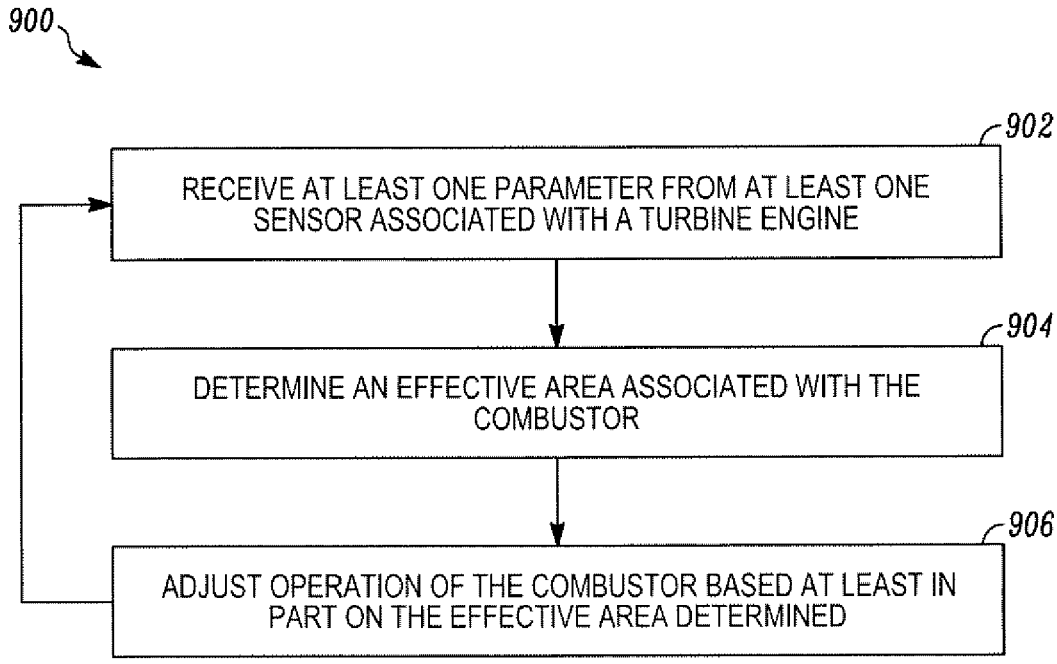

FIG. 9 illustrates a flowchart of an example method for chamber level control of emissions in a turbine engine, in accordance with an embodiment of the invention.

Figure 10:
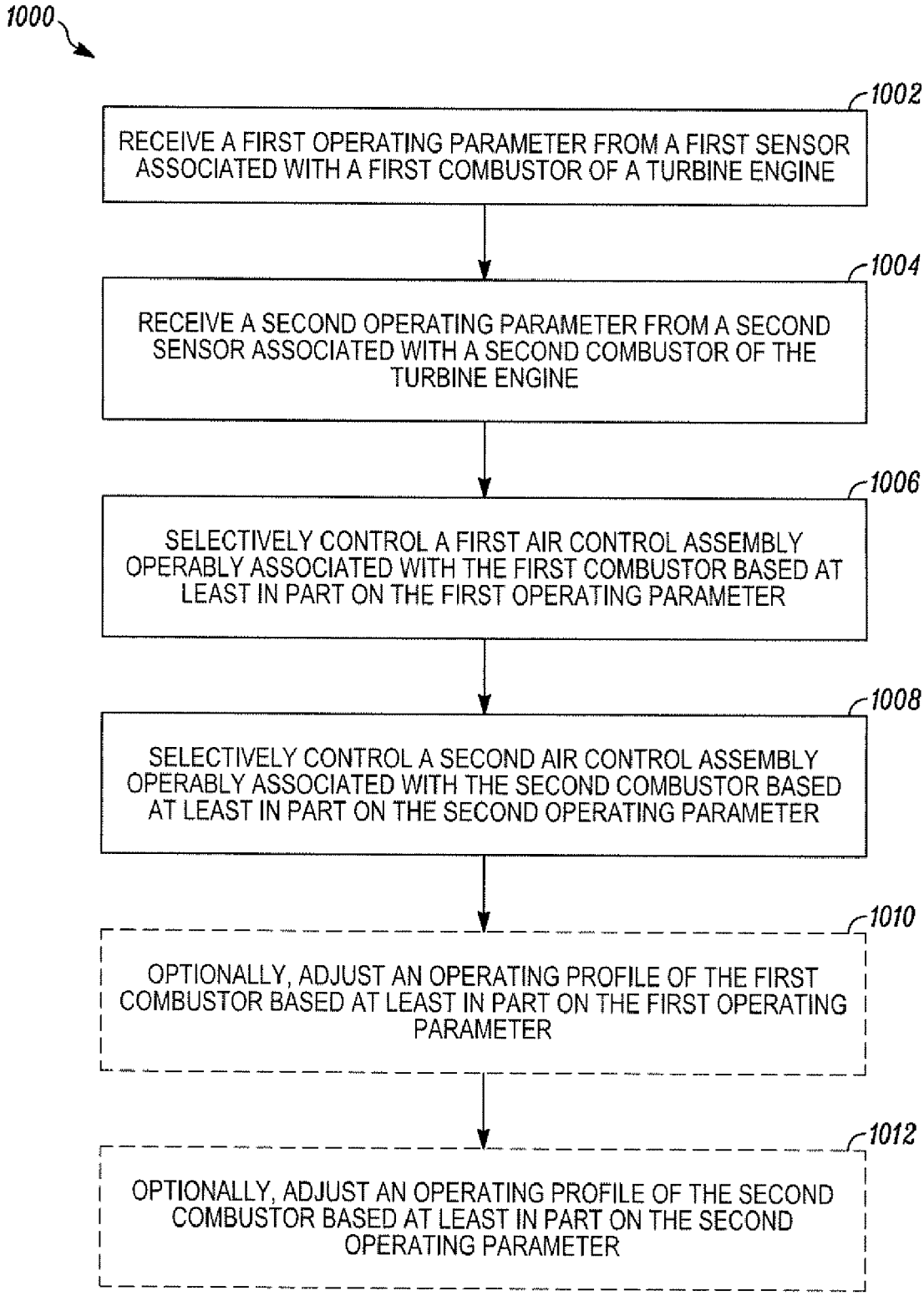

FIG. 10 illustrates a flowchart of an example method of controlling a plurality of combustors in a turbine engine, in accordance with an embodiment of the invention.

Figure 11:
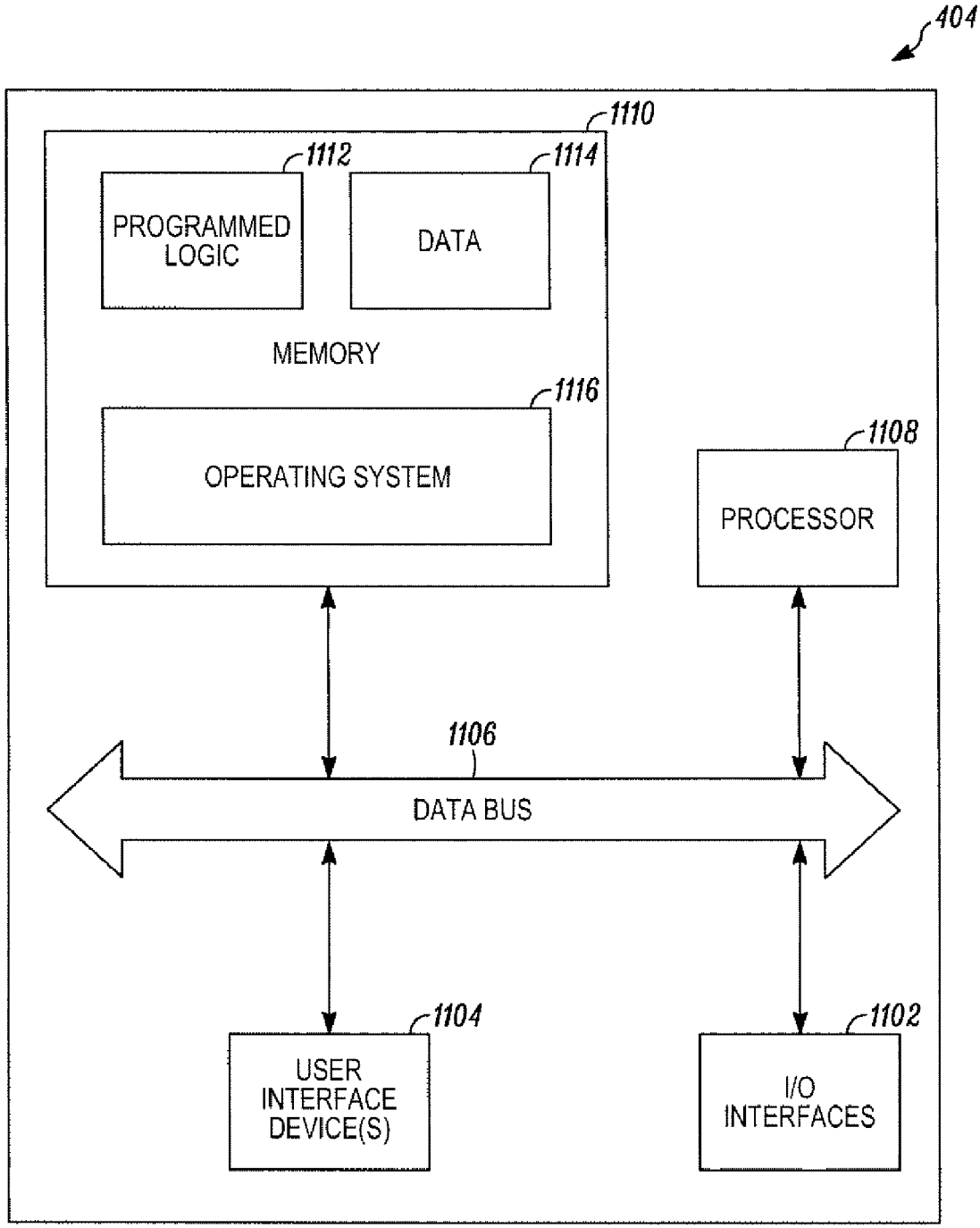

FIG. 11 is a schematic representation of an example controller, in accordance with an embodiment of the invention.

DETAILED DESCRIPTION OF THE INVENTION

Illustrative embodiments of the invention now will be described more fully hereinafter with reference to the accompanying drawings. Indeed, the invention may be embodied in many different forms and should not be construed as limited to the embodiments set forth herein; rather, these embodiments are provided so that this disclosure will satisfy applicable legal requirements. Like numbers refer to like elements throughout.

Disclosed are methods and systems for dynamic adjustment and balancing of combustors in a turbine engine, such as a gas turbine engine. According to one example embodiment, the system includes at least one sensor operable to sense to at least operating parameter associated with the turbine engine. The system also includes a controller which can be operable to selectively control an air control assembly, wherein the control may be based at least in part on the received operating parameter from the at least one sensor. Further, the air control assembly may be selectively controlled to adjust the operation of one or more combustors in a turbine engine.

The systems and methods described herein have the technical effect that one or more operating parameters of a turbine engine having one or more combustors may be communicated to a controller, whereby the controller may selectively control one or more air control assemblies to continually adjust and/or control one or more combustors of the turbine engine. Adaptive adjustment and/or control of flow in one or more combustors in the turbine engine may have the further technical effect of providing enhanced turbine operational flexibility by enabling more specific individual combustor control and dynamically tailoring combustion inputs, such as air delivery. Moreover, any impact associated with wear, changes in downstream and upstream components, ambient temperature, and air to fuel compositions are compensated for real-time. Accordingly, the systems and methods described herein have the additional technical effect of providing flexible, dynamic control of a turbine engine tailoring air deliver to one or more combustor assemblies, resulting in improved operational performance while also facilitating lower emissions.

FIG. 1 is a schematic representation of an example combined cycle power system, which is illustrated as a turbine engine 100, such as a gas turbine engine, according to one embodiment. The turbine engine 100 may include a compressor 102 and a combustor assembly 104 (herein after interchangeably referred to as a combustor). The combustor assembly 104 may include an endcover assembly 106 that seals, and at least partially defines a combustion chamber 108. Additionally, the end cover assembly 106 may support a plurality of nozzles or fuel pre-mixers, such as fuel pre-mixers 110, 112, 114 that extend into the combustion chamber 108. Further, the plurality of fuel pre-mixers 110, 112, 114 may be operable to receive fuel through a common fuel inlet 116, and compressed air from the compressor 102. While the example embodiments described herein generally refer to fuel pre-mixers, in other embodiments the turbine engine may include one or more fuel injectors, instead of or in addition to fuel pre-mixers. The fuel and the compressed air may be subsequently passed into the combustion chamber 108 and ignited to form a high temperature, high pressure combustion product or air stream which drives a turbine 118. The turbine 118 may be operationally connected to the compressor 102 through a compressor/turbine shaft 120, such as a rotor. In one example embodiment, the turbine engine 100 may include a plurality of similar combustor assemblies, having the same or similar function as the combustor assembly 104 described.

During one example operation of the turbine engine 100, air flowing into the compressor 102 may be compressed to a high pressure gas. The pressurized gas may then be injected into the plurality of fuel pre-mixers 110, 112, 114 in the combustor assembly 104. The injected pressurized gas may be mixed with fuel, such as process gas and/or synthetic gas (which may be referred to herein as syngas), to form a fuel-air mixture which is subsequently fed to the combustion chamber 108. In another example embodiment, the pressurized gas may be injected directly into the combustion chamber 108. The fuel-air mixture fed to the combustion chamber 108 may be ignited to produce a high pressure, high temperature combustion gas stream. In one example, the gas stream produced may range in temperature between approximately 871° Celsius (C.) to approximately 1593° C. In other embodiments, the combustor assembly 104 may be operable to combust fuels that include, but are not limited to natural gas and/or fuel oil. In any event, combustor assembly 104 may channel the combustion gas stream to the turbine 118 which converts thermal energy to mechanical, rotational energy.

FIG. 2 illustrates an example combustor 200, in accordance with one embodiment of the invention. In one example embodiment, the turbine engine 100 shown in FIG. 1 may include an annular combustor 200 enclosing a plurality of combustor assemblies 202, each similar to the combustor 104 as described with reference to FIG. 1. FIG. 2 illustrates an example can-annular combustor architecture, which can consist of an outer shell, with a plurality of individual cylindrical liners surrounding the plurality of combustor assemblies 202 disposed in a ring about the engine axis. The plurality of combustor assemblies 202 may be operable to provide a mixture of fuel and air to a reaction zone of the combustor 200, disposed upstream of the inlet vanes of the annular turbine, such as the turbine 118 as described with reference to FIG. 1. Furthermore, the plurality of combustor assemblies 202 may be completely surrounded by the airflow that enters the cylindrical liners through various holes and louvers. The incoming airflow in each of the plurality of combustor assemblies 202 may be mixed with fuel sprayed under pressure from fuel nozzles, and the fuel-air mixture thus formed may then be ignited by igniter plugs or spark plugs. Subsequently, the combustion process of each of the plurality of combustor assemblies 202 may interact in the reaction zone of the combustion chamber 200 as each of the plurality of combustor assemblies 202 discharge their respective combustible mixture to the reaction zone of the combustor 200. However, due to the variations in the combustors forming the combustor assembly 202, the air flow in each of the combustors may not be identical. Consequently, the combustion processes and reactions in respective combustors of the combustor assembly 202 may differ. As a result, the combustion process in one of the combustors of the combustor assembly 202 may affect the combustion processes in any other combustor of the combustor assembly 202. Thus, in a can-annular architecture, the airflow in each of the combustors forming the combustor assembly 202 may be dynamically adjusted and/or balanced to minimize interactions between the individual combustion process and thus minimize emissions, according to one example of the invention.

FIG. 3 illustrates one example embodiment of the combustor assembly 104. In FIG. 3, the combustor assembly 104 is shown to include an annular casing 300 having an end cover 302 which supports fuel pre-mixers 304, 306, 308 arranged in an annular array about the center axis of the annular casing 300. Additionally, the annular casing 300 may also include a combustion liner 310, in which the fuel-air mixture may be ignited to form the hot combustion gases. Typically the annular casing 300 can be fabricated from a material capable of withstanding a wide range of temperatures, such as carbon-steel. To avoid overexposing the annular casing 300 to the temperatures of the combustion liner 310, as well to provide the adequate air cooling for the combustion liner 310, and for mixing with the fuel, an additional liner 312 (which may be interchangeably referred to herein as a flow sleeve) can be located within the annular casing 300 and coaxial to the combustion liner 310 and the annular casing 300. The flow sleeve 312 serves to direct pressurized air along the outer walls of combustion liner 310 for cooling purposes, as well as for being injected to mix with the fuel for combustion. Additionally, the flow sleeve 312 forms an annular passageway 314 around the combustion liner 310 for directing the required amount of compressed air to the combustion liner 310 for cooling and mixing with the fuel from the pre-mixers 304, 306, 308. According to embodiments of the invention, one or more air control assemblies may be in operable communication with the annular passageway 314, or with any other air supply associated with the combustor assembly 104.

According to one embodiment, one or more air control assemblies may be positioned within the annular passageway 314, and may include a plurality of flow sleeve ports 316 enclosed in a collar 318. The collar 318 is operable to selectively compress the plurality of flow sleeve ports 316, for regulating the amount of air flowing upstream throw the annular passageway 314.

In another embodiment, one or more air control assemblies may be embodied by one or more restrictors positioned in the passageway 314 upstream of the collar 318. For example, an air control assembly embodied as a restrictor may include one or more selectively controlled caps 320. In one example embodiment, the cap 320 may be a linear seal operable to restrict flow through a respective portion of the annular passageway 314. Accordingly, the cap 320 is operable to further regulate the amount of airflow which enters the fuel pre-mixers 304, 306, 308. The cap 320 is one example of a restrictor within an annulus of the combustor 104 operable to regulate the amount of airflow that enters the fuel pre-mixers 304, 306, 308, and/or the combustor 104.

In other embodiments, an air control assembly embodied as a restrictor may be configured as a vane assembly, a flow sleeve, or an external control valve operable to limit air flow into the combustor assembly 314, such as from a compressor. In an example embodiment in which a vane assembly may be used as a restrictor, one or more vanes of the vane assembly may be operable to be rotated about axes, to selectively regulate the flow of air through the vanes, and thus through the annular passageway 314, for example. Similarly, in the example embodiment in which the restrictor may be a flow sleeve, a gear rack may be operably connected to the flow sleeve. The gear rack may actuate movement of the flow sleeve to allow and/or restrict the flow of air to the fuel pre-mixers 304, 306, 308.

The combustor assembly described with reference to FIG. 3 may be a single combustor assembly in a turbine engine, or may represent a plurality of combustor assemblies, such as can be arranged in a can-annular configuration, as described with reference to FIG. 2, or in any other suitable configuration.

FIG. 4 illustrates an example control system 400 in a turbine engine, according to one embodiment. FIG. 4 shows a block diagram representation of the combustor assembly 104 in flow communication with the turbine 118 of the turbine engine 100, as is described with reference to FIG. 1. Each of the combustor assembly 104 and the turbine 118 shown in FIG. 4, or other components of or in association with the turbine engine 100, may include a plurality of sensors 402. Examples of the plurality of sensors 402 may include, but are not limited to, exhaust temperature sensor, a dynamic pressure sensor, a turbine inlet air temperature sensor, a turbine mass flow sensor, a compressor exit temperature sensor, a compressor exit pressure sensor, an emissions sensor, a flame detector, a static air pressure sensor, a static air temperature sensor, a flame optical emissions sensor, an ionization detector, an ambient air temperature sensor, a power meter, a delta pressure sensor, a single-point fluid flow meter, or an ultraviolet sensor. The plurality of sensors 402 are operable to sense at least one operating parameter of the turbine engine 100. The operating parameter or parameters sensed by one or more of the plurality of sensors 402 may be communicated to a controller 404, such as through either electrical or any other suitable means for communicating sensor measurements.

In the controller 404, the one or more operating parameters sensed by the one or more sensors 402 may be used at least in part to determine an effective flow area associated with the combustor assembly 104. Example operating parameters sensed by the one or more sensors 402 for determining effective flow area may include, but are not limited to, pressures and pressure losses, temperatures, flows, emissions, and the like. Effective flow area may be defined as the net area of a flow inlet or a flow outlet through which a flow can pass. The determined effective flow area may then be used to control one or more air control assemblies. For example, the determined effective flow area may be compared to a look-up table containing standard values of effective flow area, which may aid in calculating or otherwise determining appropriate adjustments to the air flow in the combustor assembly. Based at least in part on the comparison, the controller 404 may be further operable to send appropriate control commands to a plurality of air control assemblies 406. Based on the control commands received from the controller 404, the plurality of air control assemblies 406 associated with at least one air path of the combustor assembly 104, and in electrical communication with the controller 404 may be operable to control the effective flow area of the air path of the combustor assembly 104 using flow control valves 408 or other actuated or selectively controllable air control assembly components, such as collars, vanes, caps, and the like. The terms "air control assembly" and "control valve" may be used interchangeably herein, and each may generally refer to an assembly or system for controlling air flow through or associated with a turbine engine. Controlling the effective flow area of the air path associated with the combustor assembly 104 may facilitate the regulation/control of fuel-air ratio of the fuel-air mixture in the combustor assembly 104.

FIG. 3 above describes in more detail example air control assembly components, as do FIGS. 5-7 described below.

FIG. 5 illustrates one example embodiment of a combustor assembly, similar to combustor assembly 104 as described with reference to FIG. 3, including one or more air control assemblies. In the example embodiment shown in FIG. 5, the combustor assembly 500 includes an air control assembly that includes an external air bypass 502 from the compressor, such as the compressor 102 as described with reference to FIG. 3, to the combustor assembly 500. Cool, compressed air 502 may be bypassed from the compressor exit and injected into the combustor assembly 500 through an external air path. The compressed air 502 may be primarily injected into the combustor assembly 500 to mix with the fuel for combustion. In addition, the amount of compressed air 502 injected into the combustor assembly 500 may be regulated via the air control assembly by a control valve 504 operationally placed in the external air path of the bypassed compressed air 502. The control valve 504 may be selectively controlled by a controller, such as the controller 404 described with reference to FIG. 4, to adjust the operation of the combustor assembly 500. In one example embodiment, the combustor assembly 500 may include a plurality of combustor assemblies, each combustor assembly similar to the combustor assembly 500. Thus, to balance the operation of a respective combustor assembly, each combustor assembly may have an individual external air bypass circuit.

FIG. 6 illustrates another example embodiment of a combustor assembly, similar to the combustor assembly 104 as described with reference to FIG. 3, including one or more air control assemblies. In the example embodiment shown in FIG. 6, the combustor assembly 600 includes an air control assembly configured as one or more air flow restrictors placed in the annular passage of the combustor, such as internal guide vanes 602. In this example embodiment, guide vanes are described, however other restricting means may be included for selectively controlling air through the annular passage of the combustor 500. The internal guide vanes 602 may be placed upstream of the combustion liner 310, and may be selectively controlled by vane actuators 604 to regulate the amount of air entering the pre-mixers 304, 306, 308. The vane actuators 604 may be further controlled by a controller, such as the controller 404 as described with reference to FIG. 4, based at least in part on one operating parameter sensed by at least one sensor in the turbine engine. In one example embodiment, the combustor assembly 600 may include a plurality of combustor assemblies, each combustor assembly similar to the combustor assembly 104. Thus, to balance the operation of a respective combustor assembly, each combustor assembly may have an individual internal air bypass circuit with guide vanes.

FIG. 7 illustrates another example embodiment of a combustor assembly, similar to the combustor assembly 104 as described with reference to FIG. 3, including one or more air control assemblies. In the example embodiment shown in FIG. 7, the combustor assembly 700 may include an air control assembly configured as a sleeve 702 operationally connected to a gear drive rack 704 to regulate air-flow into the fuel pre-mixers 304, 306, 308. In this example, the air flow directed upstream of the annular passageway 314 may be regulated before entering the fuel pre-mixers 304, 306, 308, using a cap 320. The cap 320 may be operationally connected to the sleeve 702, which in turn is operably connected to the gear drive rack 704. The movement of the sleeve 702 may be operable to selectively cover or uncover the air flow path with the cap 320. The extent of covering or uncovering by the cap 320 may regulate the amount of air entering the fuel pre-mixers 304, 306, 308. The gear drive rack 704 may be controlled by a controller 706, such as or similar to the controller 404 as described with reference to FIG. 4, based at least in part on one operating parameter sensed by at least one sensor in the turbine engine. In one example embodiment, a combustor may include a plurality of combustor assemblies, each combustor assembly similar to the combustor assembly 700. Thus, to balance the operation of a respective combustor assembly, each combustor assembly may have an individual internal air bypass circuit with sleeves FIG. 8 illustrates a flowchart of an example method 800 for altering the airflow associated with a combustor in a turbine engine.

The example method may begin at block 802. At block 802, at least one operating parameter is received from at least one sensor associated with a turbine engine. At least one sensor may be positioned in the compressor, combustor, turbine, or otherwise associated with the turbine engine. The sensor can be operable to sense at least one operating parameter of the turbine engine. In one example embodiment, the sensor may be one or more pressure sensors positioned appropriately to measure the pressure loss between the combustor and the turbine. Other sensors for sensing other operating parameters of or associated with the turbine engine can be used in example embodiments.

Following block 802 is block 804, in which an air control assembly associated with an air path of the combustor is selectively controlled based at least in part on the at least one operating parameter. The at least one parameter received from the at least one sensor at block 802 may be provided to a controller in communication with the at least one sensor. Based at least in part on the at least one parameter provided, the controller selective controls an air control assembly to alter the airflow in the turbine engine. In one example embodiment of the invention, the controller may use the at least one parameter to calculate the effective flow area associated with the combustor, which may aid in determining the appropriate control action for selectively controlling the air control assembly or assemblies. In other embodiments, other operating parameters, which may include or differ from effective flow area, can be used at least in part to determine appropriate control of the air control assembly or assemblies.

The method 800 may end after block 804.

FIG. 9 illustrates a flowchart of one example method 900 for chamber level control of emissions in a combustor of a turbine engine. The example method 900 illustrates a closed loop process which can be implemented to adaptively alter the airflow in the combustor and/or adjust the operation of the combustor of the turbine engine to optimize emissions.

The example method may begin at block 902. At block 902, at least one operating parameter is received from at least one sensor associated with a turbine engine. At least one sensor positioned in the compressor, combustor, and/or turbine, or otherwise associated with the turbine engine, may sense at least one operating parameter of or associated with the turbine engine. In one embodiment, example sensors may include, but are not limited to an exhaust temperature sensor, a dynamic pressure sensor, a turbine inlet air temperature sensor, a turbine mass flow sensor, a compressor exit temperature sensor, a compressor exit pressure sensor, an emissions sensor, a flame detector, a static air pressure sensor, a static air temperature sensor, a flame optical emissions sensor, an ionization detector, an ambient air temperature sensor, a power meter, a delta pressure sensor, a single-point fluid flow meter, and an ultraviolet sensor.

Following block 902 is block 904, in which an effective flow area associated with the combustor may be determined. The at least one parameter received from the at least one sensor at block 902 may be provided to a controller in communication with the at least one sensor. The controller may be operable to determine the effective flow area associated with the combustor based at least in part on the at least one parameter provided by the at least one sensor. In other embodiments, other operating parameters, which may include or differ from effective flow area, can be used at least in part to determine appropriate control of the air control assembly or assemblies.

Following block 904 is followed by block 906, in which operation of the combustor may be adjusted based at least in part on the effective flow area (and/or other operating parameter) determined. Based at least in part on the effective flow area determined at block 904, the controller may be operable to adjust the operation of the combustor of the turbine engine. In one example embodiment, an air control assembly operably associated with an air path of a combustor of the turbine engine may be selectively controlled by the controller based at least in part on the effective flow area determined. In one example, the effective flow area determined by the controller over the operation cycle of the turbine engine may be compared to a look-up table containing standard values of effective flow area. Based at least in part on the comparison, the controller may selectively control one or more air control assemblies in communication with or otherwise associated with the controller to change the effective flow area of the combustor. This can cause a change in the operating conditions associated with the combustor, and hence the at least one parameter sensed by the at least sensor in the turbine engine also changes from which an effective flow area is further determined. Accordingly, block 902 follows 906 and the process forms a closed loop, whereby the operating parameters of the turbine engine may be repeatedly or continually sensed, effective flow areas and/or other conditions may be re-determined, and the turbine engine may be continuously and/or dynamically adjusted based at least in part on the repeated measurements and alterations of the air control assemblies, for example.

The method 900 may end after block 906.

FIG. 10 illustrates a flowchart of one example method 1000 of controlling a plurality of combustors in a turbine engine, according to one embodiment. In the embodiment shown, the example method 1000 can be implemented to achieve dynamic adjustment and balancing of air flow in a plurality of combustors of the turbine engine.

The example method may begin at block 1002. At block 1002, a first operating parameter is received from a first sensor associated with a first combustor of a turbine engine. The first combustor may include at least a first sensor to sense the operating conditions of the first combustor. Examples of the first sensor may include, but are not limited to, any sensors described herein. At the start of an operating cycle, the first sensor may sense at least a first parameter from the operating conditions of the first combustor.

Following block 1002 is block 1004, in which a second operating parameter is received from a second sensor associated with a second combustor of the turbine engine. The second combustor may also include at least a second sensor, which may include, but is not limited to, any sensors described herein. At the start of an operating cycle, the second sensor may be operable to sense at least a second parameter from the operating conditions of the second combustor.

Following block 1004 is block 1006, in which a first air control assembly associated with the first combustor can be selectively controlled based at least in part on the first operating parameter. Based at least in part on the first operating parameter sensed by the first sensor associated with the first combustor, a control action may be initiated through a first air control assembly to adjust the operation of the first combustor of the turbine engine. In one example embodiment, the first parameter sensed by the first sensor may be used by a controller to determine an effective flow area associated with the first combustor during the operating cycle of the turbine engine. The controller may be further operable to control the first air control assembly associated with the first combustor to adjust and/or regulate the amount of air flow into fuel pre-mixers associated with the first combustor.

Following block 1006 is block 1008, in which a second air control assembly associated with the second combustor is selectively controlled based at least in part on the second operating parameter. In one example embodiment, based at least in part on the second parameter sensed by the second sensor, the controller may determine an effective flow area associated with the second combustor during the operating cycle. The controller may be further operable to control and/or adjust the operating conditions of the second combustor through a selective control of the second air control assembly associated with the second combustor.

Following block 1008 is an optional block 1010, in which an operating profile of the first combustor is adjusted based at least in part on the first operating parameter. The selective control of the first air control assembly associated with the first combustor at block 1006 may change the operating conditions of the first combustor of the turbine engine, thus, the operating profile of the first combustor may be adjusted to balance the air flow in the first combustor with respect to the air flow changes in this and the other combustors.

Following block 1010 is an optional block 1012, in which an operating profile of the second combustor is adjusted, based at least in part on the second operating parameter, in a manner similar to that described with reference to block 1010.

The method 1000 may end after block 1012.

FIG. 11 is a schematic representation of an example controller, such as the controller 404, in electrical communication with at least one sensor 402, as described with reference to FIG. 4. In an embodiment of the invention, the controller 404 may be a Programmable Logic Controller (PLC). The controller 404 comprises an input-output interface 1102 such as sensors, network ports etc for receiving signals from the at least one sensor 402. Moreover, users may also interface with the controller 404 via a user interface device(s) 1104, such as a keyboard, mouse, control panel, or any other devices capable of communicating data to and from the controller 404. The signals entering the controller 404, flow from the input-output interface 1102 or the user interface device(s) 1104 through a data bus 1106 and into the different components of the controller 404. The controller 404 further includes a processor 1108 to perform high speed operations. In an embodiment of the invention, the processor 1108 may be a high-speed processor for meeting the high-speed requirements in calculating the effective flow area of a plurality of combustor assemblies in real time. The controller 404 may further include a memory 1110 that stores programmed logic 1112 (e.g., software) and may store data 1114, such as values of effective flow area, for example. The memory 1110 may also include an operating system 1116 on which programs embedded in the controller 404 may run. In an embodiment of the invention, the operating system 16 may be a Real Time Operating System. The processor 1108 may utilize the operating system 1116 to execute the programmed logic 1112, and in doing so, also may utilize the data 1114. Further, the controller 404 and the programmed logic 1112 implemented thereby may include software, hardware, firmware, or any combination thereof.

Fuel-air balance can be particularly important for low emission combustion systems. Dynamic air balancing allows continuous adjustment of air flow in combustors even as the structural and the dimensional characteristics of the combustors change over time. Further balancing the air supplied to each of a plurality of combustors in a turbine engine with multiple combustors can reduce the peak reaction zone temperatures and hence emissions. Uniform or adjustable fuel-air ratio in each of the plurality of combustors can result in uniform or desired pressure and temperature distribution across the different combustors, thus reducing mechanical and thermal stress.

At this point it should be appreciated that embodiments described herein can provide for individual chamber-level combustion monitoring and closed-loop control that permits moment-by-moment tailoring of air flow in each individual combustor assembly in order to suit the external and internal gas turbine system variables specific to that particular gas turbine, site, and load condition. Independent combustor control can provide distinct benefits by allowing very low load turndown with the turbine engine remaining emission compliant Combustor exit temperature and operating mode can be varied independently in each chamber, allowing the average turbine inlet temperature to be reduced to spinning reserve levels, while some combustor assemblies remain at the relatively high exit temperatures required for in-compliance emissions levels. Alternate combustors could be independently operated in more stable mode, or shut off altogether.

While the invention has been described in connection with what is presently considered to be the most practical and various embodiments, it is to be understood that the invention is not to be limited to the disclosed embodiments, but on the contrary, is intended to cover various modifications and equivalent arrangements included within the scope of the appended claims.

This written description uses examples to disclose the invention, including the best mode, and also to enable persons to practice the invention, including making and using any devices or systems and performing any incorporated methods. The patentable scope the invention is defined in the claims, and may include other examples. Such other examples are intended to be within the scope of the claims if they have structural elements that do not differ from the literal language of the claims, or if they include equivalent structural elements with insubstantial differences from the literal languages of the claims.

The claimed invention is:

1. A system for controlling a combustor of a turbine engine, comprising:

an air control assembly operably associated with at least one air path of a combustor of a turbine engine;

at least one sensor operable to sense at least one operating parameter of the turbine engine; and a controller operable to selectively control the air control assembly based at least in part on the at least one operating parameter sensed by the at least one sensor, wherein the controller is further operable to determine an effective flow area of a variable air path associated with the combustor based at least in part on the at least one operating parameter, and is further operable to selectively control the air control assembly based at least in part on the effective flow area determined by the controller.

2. The system of claim 1, wherein the at least one sensor comprises a plurality of sensors, and wherein the controller is operable to selectively control the air control assembly based at least in part on the at least one operating parameter sensed by at least one of the plurality of sensors.

3. The system of claim 1, wherein the at least one sensor comprises at least one of an exhaust temperature sensor, a dynamic pressure sensor, a turbine inlet air temperature sensor, a turbine mass flow sensor, a compressor exit temperature sensor, a compressor exit pressure sensor, an emissions sensor, a flame detector, a static air pressure sensor, a static air temperature sensor, a flame optical emissions sensor, an ionization detector, an ambient air temperature sensor, a power meter, a delta pressure sensor, a single-point fluid flow meter, or an ultraviolet sensor.

4. The system of claim 1, wherein the controller is further operable to determine an effective flow area associated with the combustor during operation of the turbine engine and to adjust operation of the combustor based at least in part on the effective flow area determined by the controller.

5. The system of claim 4, wherein the controller is operable to selectively control the air control assembly to adjust operation of the combustor based at least in part on the effective flow area determined by the controller.

6. The system of claim 1, wherein the combustor comprises a first combustor and the air control assembly comprises a first air control assembly operably associated with an air path of the first combustor, the system further comprising:

a second combustor of the turbine engine; and a second air control assembly operably associated with an air path of the second combustor;

wherein the controller is operable to selectively control the first air control assembly independent of the second air control assembly based at least in part on the at least one operating parameter sensed by the at least one sensor.

7. The system of claim 1, wherein the air control assembly comprises at least one collar arranged proximate to a flow sleeve of the combustor, and wherein the controller is operable to selectively adjust the at least one collar to alter airflow through the flow sleeve by altering an effective flow area associated with the flow sleeve.

8. The system of claim 1, wherein the air control assembly comprises a restrictor positioned within an annulus of the combustor through which air may flow into at least one fuel premixer or combustion chamber, and wherein the controller is operable to selectively adjust the restrictor to alter airflow through the annulus.

9. The system of claim 8, wherein the restrictor comprises at least one vane or foil positioned within the annulus of the combustor upstream of a combustion liner.

10. The system of claim 1, wherein the air control assembly comprises at least one cover arranged proximate to an air inlet of at least one fuel premixer or fuel injector, and wherein the controller is operable to selectively adjust the at least one cover to alter airflow through the at least one fuel premixer or fuel injector.

11. A method for controlling a turbine engine, comprising: receiving at least one operating parameter from at least one sensor associated with a turbine engine;

determining an effective flow area of a variable flow path associated with the combustor, wherein the effective flow area is based at least in part on the at least one operating parameter; and selectively controlling, based at least in part on the effective flow area, an air control assembly operably associated with an air path of a combustor of the turbine engine.

12. The method of claim 11, further comprising:

determining an effective flow area associated with the combustor during operation of the turbine engine; and:

adjusting operation of the combustor based at least in part on the effective flow area determined during operation of the turbine engine.

13. The method of claim 11, wherein the combustor comprises a first combustor and the air control assembly comprises a first air control assembly; the method further comprising:

selectively controlling a second air control assembly associated with an air path of a second combustor of the turbine engine independent of the first air control assembly.

14. The method of claim 13, wherein the at least one operating parameter comprises a first operating parameter associated with the first combustor and a second operating parameter associated with the second combustor; the method further comprising:

selectively controlling the first air control assembly based at least in part on the first operating parameter; and selectively controlling the second air control assembly based at least in part on the second operating parameter.

15. The method of claim 11, wherein selectively controlling the air control assembly operably comprises at least one of: altering airflow through a flow sleeve, altering airflow through an annulus of the combustor through which air may flow into at least one fuel premixer, fuel injector, or combustion chamber, or altering airflow through at least one fuel premixer or fuel injector.

16. The method of claim 11, wherein receiving the at least one operating parameter comprises receiving at least one of: an exhaust temperature, a dynamic pressure, a turbine inlet air temperature, a turbine mass flow, a compressor exit temperature, a compressor exit pressure, an emissions indication, a flame detection indication, a static air pressure, a static air temperature, a flame optical emissions indication, an ionization indication, an ambient air temperature, a power indication, a delta-pressure sensor, a single-point fluid flow meter, or an ultraviolet indication.

17. A method for controlling a turbine engine, comprising:

receiving a first operating parameter from a first sensor associated with a first combustor of a turbine engine;

receiving a second operating parameter from a second sensor associated with a second combustor of the turbine engine;

based at least in part on the first operating parameter, determining a first effective flow area of a first variable flow path associated with the first combustor;

based at least in part on the second operating parameter, determine a second effective flow area of a second variable flow path associated with the second combustor;

selectively controlling, based at least in part on the first effective flow area, a first air control assembly operably associated with the first combustor; and selectively controlling, based at least in part on the second effective flow area, a second air control assembly operably associated with the second combustor.

18. The method of claim 17, further comprising:

adjusting an operating profile of the first combustor based at least in part the first operating parameter; and adjusting an operating profile of the second combustor based at least in part on the second operating parameter.

* * * * *